US006409417B1

(12) United States Patent
Muller et al.

(10) Patent No.: US 6,409,417 B1
(45) Date of Patent: Jun. 25, 2002

(54) SAFETY ROAD BARRIER END ASSEMBLY WITH A GRADUAL ABSORPTION OF THE IMPACT ENERGY

(76) Inventors: Franz Muller, Via Scheiwiller, 1, 20122; Marco Anghileri, Via Londonio, 10, 20100, both of Milano (IT)

( * ) Notice: Subject to any disclaimer, the term of this patent is extended or adjusted under 35 U.S.C. 154(b) by 0 days.

(21) Appl. No.: 09/496,837

(22) Filed: Feb. 2, 2000

(30) Foreign Application Priority Data

Feb. 3, 1999 (IT) ..... MI99A0196

(51) Int. Cl.[7] ..... G01F 15/00
(52) U.S. Cl. ..... 404/6; 256/13.1
(58) Field of Search ..... 404/6, 9, 10; 256/13.1

(56) References Cited

U.S. PATENT DOCUMENTS 4,583,716 A * 4/1986 Stephens et al. ..... 256/13.1
4,655,434 A * 4/1987 Bronstad ..... 256/13.1
5,022,782 A * 6/1991 Gertz et al. ..... 404/6
5,660,496 A * 8/1997 Muller et al. ..... 404/6
5,775,675 A * 7/1998 Sicking et al. ..... 256/13.1
5,791,812 A * 8/1998 Ivey ..... 404/6
5,797,591 A * 8/1998 Krage ..... 256/13.1
5,851,005 A * 12/1998 Muller et al. ..... 256/13.1
5,924,680 A * 7/1999 Sicking et al. ..... 256/13.1
5,957,435 A * 9/1999 Bronstad ..... 256/13.1
6,022,003 A * 2/2000 Sicking et al. ..... 256/13.1
6,109,597 A * 8/2000 Sicking et al. ..... 256/13.1
6,129,342 A * 10/2000 Bronstad ..... 256/13.1

* cited by examiner

*Primary Examiner*—H. Shackelford
*Assistant Examiner*—Gary S. Hartmann
(74) *Attorney, Agent, or Firm*—Hedman & Costigan, P.C.

(57) ABSTRACT

A metal modular end assembly for a safety road barrier gradually absorbing the impact energy of a motor vehicle comprises longitudinally corrugated metal slotted panels coupled by sliders to supporting piers which are anchored to the ground, thereby an impact of a vehicle will force the sliders to friction engage and deform the panel slots to dissipate the impact kinetic energy of the impacting vehicle.

4 Claims, 5 Drawing Sheets

SAFETY ROAD BARRIER END ASSEMBLY WITH A GRADUAL ABSORPTION OF THE IMPACT ENERGY

BACKGROUND OF THE INVENTION

The present invention relates to a safety road barrier end assembly specifically designed for safely operating and provided with a gradual absorption of the impact energy.

As is known, urban, extra-urban roads and highways have a lot of dangerous points including rigid obstacles or sloping areas, as well as pedestrian or cyclist passages, which are protected by safety barriers which can be either of a metal or of a concrete type.

The metal road barriers, which are the most diffused protective barriers for all applications, generally comprise a plurality of steel strip segments, provided with "waved" or corrugated cross sections, thereby providing a comparatively high moment of inertia and according a good flexural strength, said barrier segments being conventionally coupled to piers anchored or bolted to the ground.

The above mentioned barriers, owing to an advanced designing in recent years, provide a satisfactory performance for substantially all of the impacts provided by the enforcing standards, in particular by the EPO standards, as the impacts occur at a given point of the extension of the barrier.

However, problems can occur as the vehicle impact affects end portions of said barriers, mainly as said barriers, as it frequently occurs, are not sufficiently spaced in a width direction with respect to the traffic lane.

Actually, conventional metal safety barriers are only provided with end elements or assemblies of a "hand" or of a "fan" type, or they are provided with a corrugated web portion as bent at the ground level.

The first mentioned types of end assemblies, i.e. the so-called "hand" end or terminal assemblies, or the so-called "fan" end assemblies, have a merely visual function, without any strength properties, both of angular and side type, and they are very dangerous for all the front impacts or the angled front impacts, since the barriers would tend to operate as a tip-impacted beam, with consequent intrusion effects with respect to the motor vehicle.

The second end assembly, i.e. the ground bent end assemblies, are susceptible to frequently cause the impacting motor vehicle to be upturned, with very dangerous consequences.

Yet other end assemblies for barriers, designed for other traffic and motor vehicle types, for example those used on USA safety barriers, are very complex and expensive and do not properly operate under the typical conditions of the European and Italian roads characterized by a high speed traffic, as well as by a disordered traffic with a higher proportion of light vehicles.

In this connection reference is herein made to the U.S. Pat. No. 5,078,366 in the name of Sicking et al, disclosing a safety road barrier end assembly provided with a specifically designed head adapted to extrude the guardrail strip so as to provide a "loop" of a comparatively large size, and the PCT application WO 96/13972 to Sicking et al, disclosing a safety barrier end assembly including a head portion having a plurality of knife elements designed for longitudinally cutting the strip, thereby weakening it and favoring the so-called "buckling" effect.

SUMMARY OF THE INVENTION

Accordingly, the aim of the present invention is to overcome the above mentioned problems, by providing a road safety barrier having suitable safety properties and which is specifically designed to meed the enforcing standards by gradually absorbing the motor vehicle impact energy, thereby reducing the impact effects on the motor vehicle and on the persons therein.

Within the scope of the above aim, a main object of the present invention is to provide an end assembly for a safety road barrier, having very high strength characteristics, both under mainly longitudinal impacts and under mainly lateral impacts.

Another object of the present invention is to provide such an end assembly for safety road barriers, which can be easily assembled and used together with the existing metal road barriers.

Yet another object of the present invention is to provide such a road barrier end assembly which can be easily made starting from easily available elements and materials and which, moreover, is very competitive from a mere economic standpoint.

According to one aspect of the present invention, the above mentioned aim and objects, as well as yet other objects, which will become more apparent hereinafter, are achieved by a safety road barrier end assembly provided with a gradual absorption of an impact energy, characterized in that said end assembly comprises grooved corrugated elements coupled. to a front side facing a road of supporting piers, said corrugated elements being coupled to said supporting piers by sliding coupling means, for causing a friction and plastic deformation of said slots in a direction parallel to a longitudinal extension of said barrier, anchoring means for anchoring said supporting piers to a ground being moreover provided.

The absorption of the impact energy in a longitudinal direction of the barrier occurs mainly by a plastic deformation of the metal forming the corrugated elements and, more specifically, by a variation of the shape and size of the longitudinal slots in said elements, by the sliding elements rigid with the supporting piers.

BRIEF DESCRIPTION OF THE DRAWINGS

Further characteristics and advantages of the safety road barrier end assembly according to the present invention will become more apparent hereinafter from the following disclosure of a preferred, though not exclusive, embodiment of the mentioned end assembly, being illustrated, by way of an indicative, but not limitative, example in the accompanying drawings, where.

DESCRIPTION OF THE PREFERRED EMBODIMENTS

With reference to the number references of the above mentioned figures, the safety road barrier end assembly, according to the present invention, which has been generally indicated by the reference number 1, comprises a plurality of horizontally extending lateral corrugated elements or panels 2, including preferably corrugated metal strip panels having a multiple corrugated configuration thereby providing a high moment of inertia, preferably a triple corrugation, such as the metal barrier corrugated element as used conventionally and which are easily available.

More specifically., the corrugated strip panels or elements 2 are coupled to the front side, i.e. the side facing the motor vehicle traffic, of supporting piers 3, which are coupled to the corrugated elements 2 by sliding coupling means or slider arranged. in hollows formed in a direction parallel to the longitudinal extension of the barrier, as it will become more apparent hereinafter.

For anchoring and aligning the supporting piers 3 to the ground are provided anchoring and aligning means.

Figure 1:
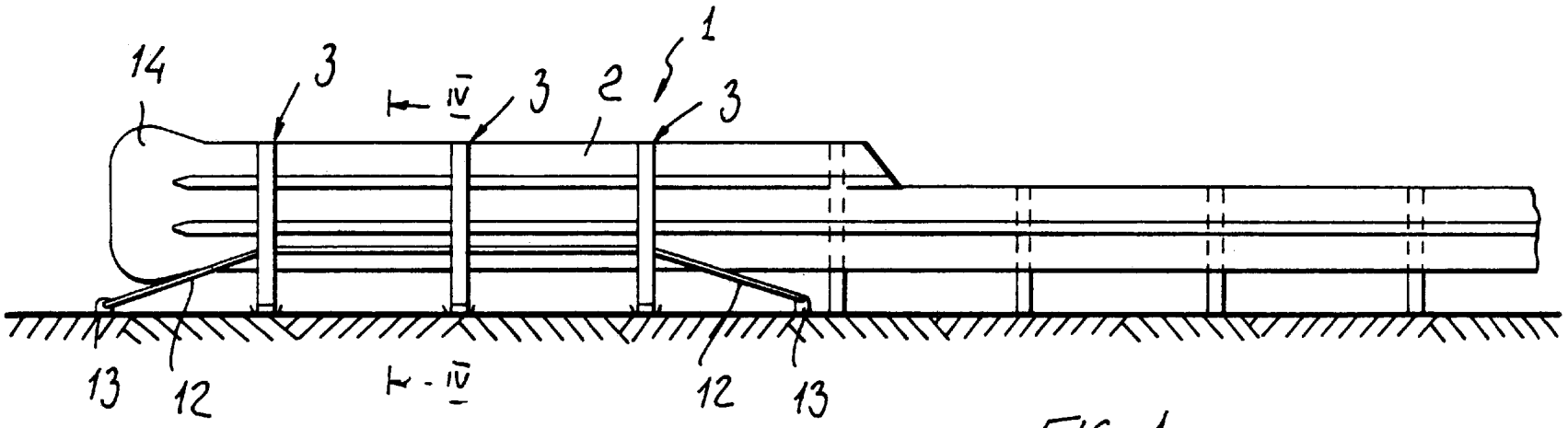
FIG. 1 is a rear elevation view illustrating the safety road barrier end assembly according to the present invention.
Figure 2:
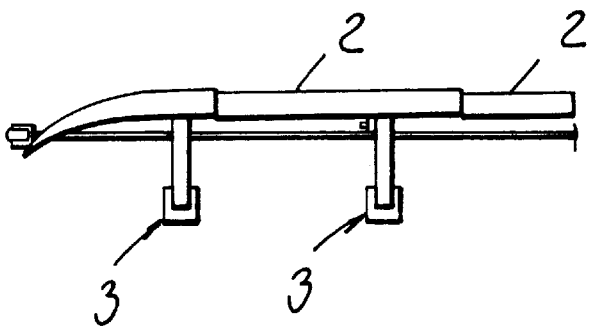
FIG. 2 is a top plan view, as partially cross-sectioned, of the end assembly according to the invention.
Figure 3:
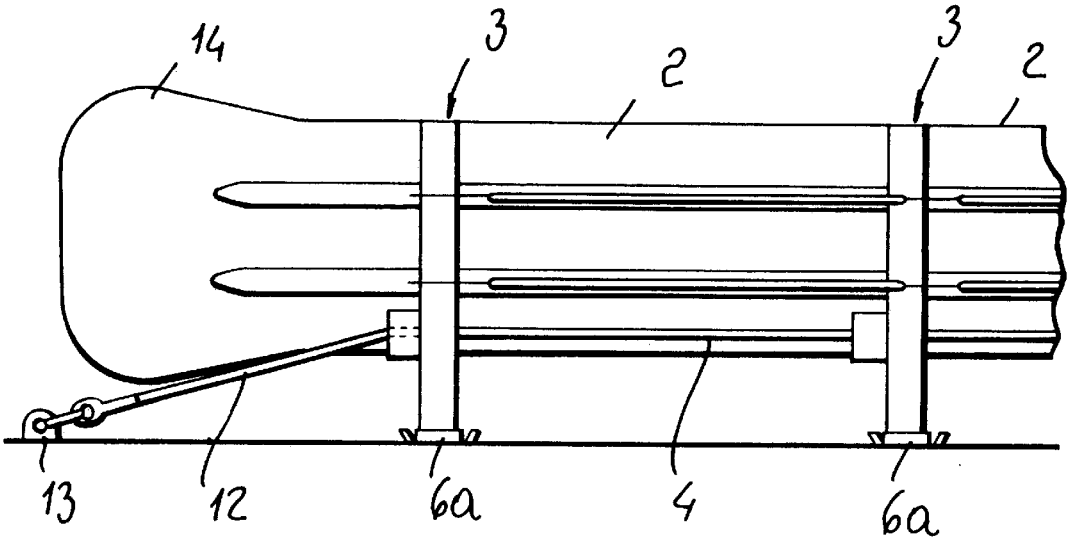
FIG. 3 illustrates an enlarged detail of FIG. 1.
Figure 4:
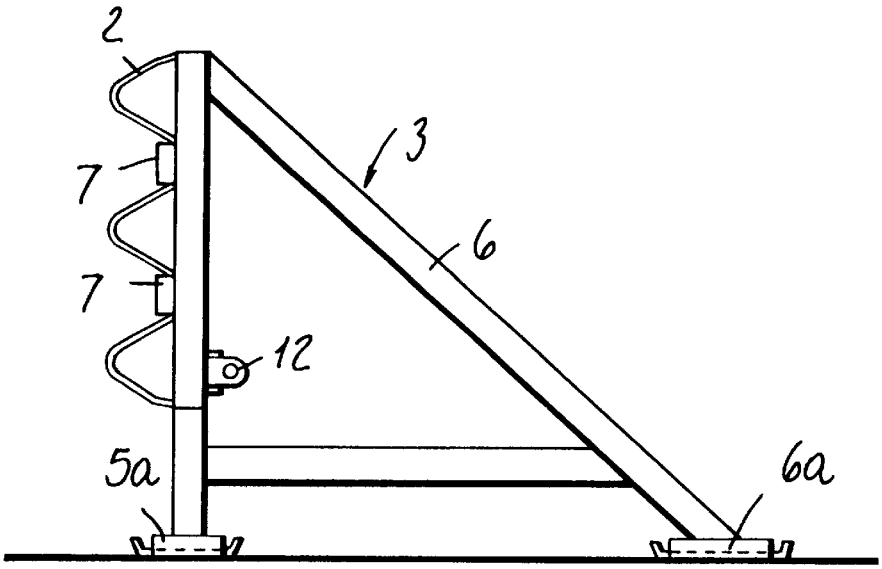
FIG. 4 is a schematic cross sectional view of FIG. 1, substantially taken along the section line IV—IV.
Figure 5:
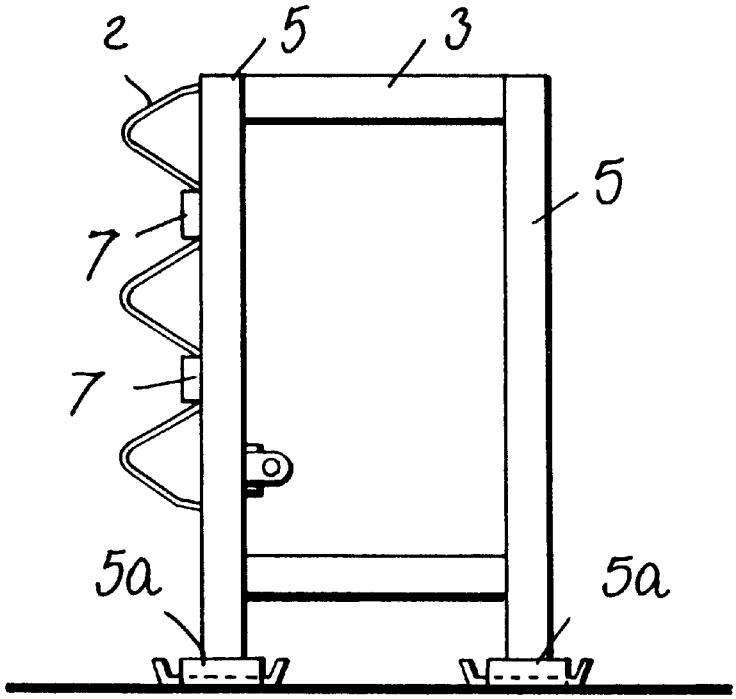
FIG. 5 illustrates a modified embodiment of the detail shown in FIG. 4.
Figure 6:
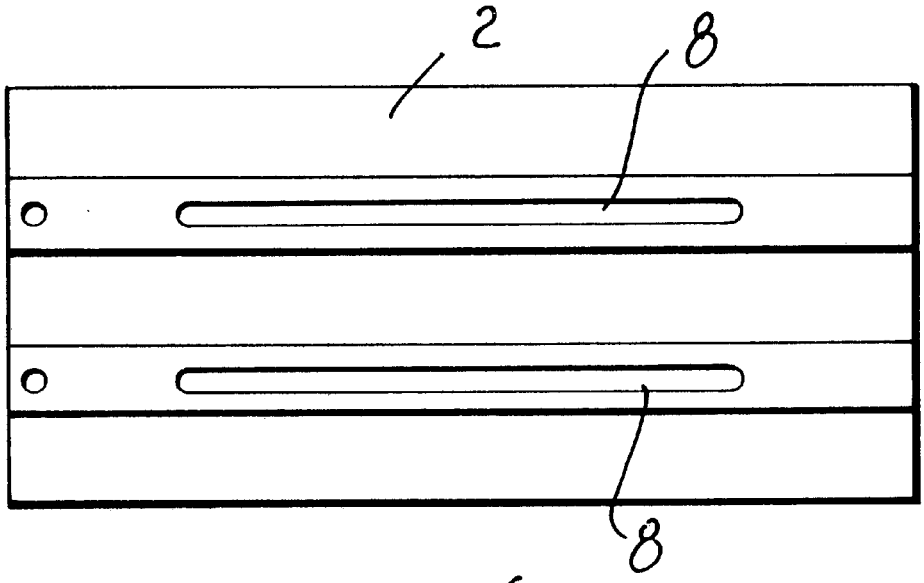
FIG. 6 is a side view of the corrugated element or panel.
Figure 7:
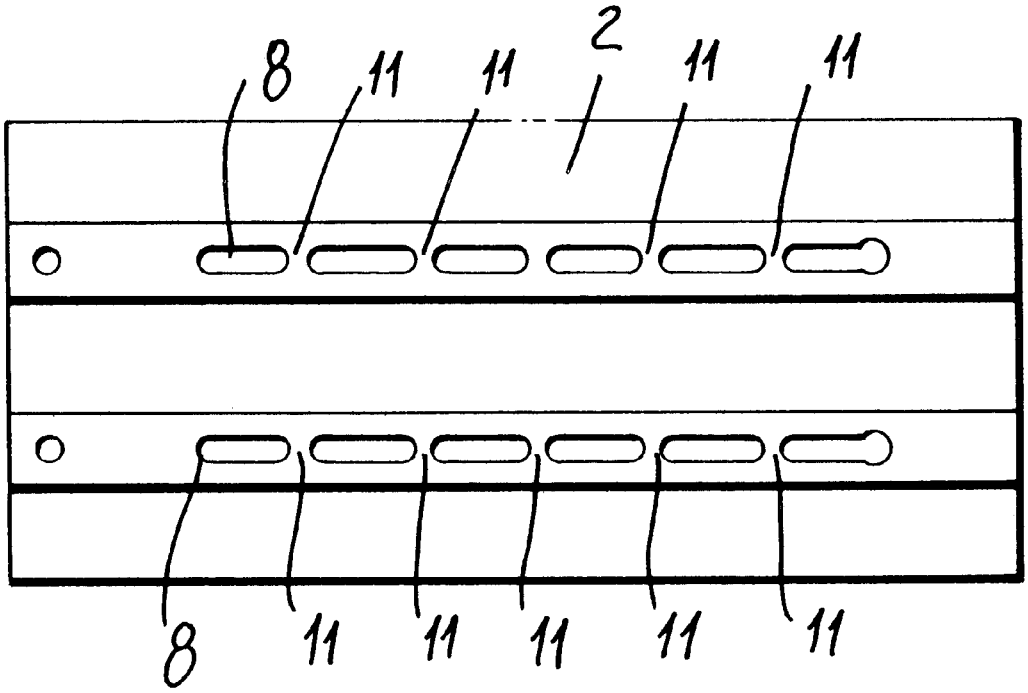
FIG. 7 illustrates a preferred embodiment of the corrugated element.
Figure 8:
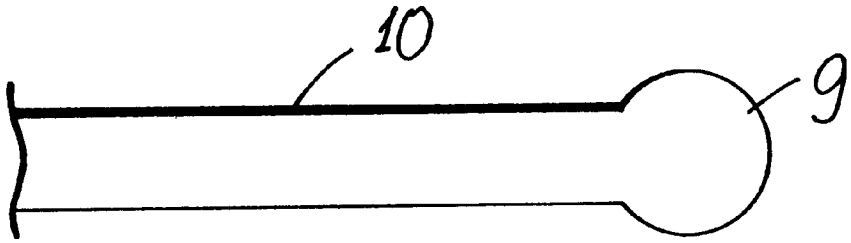
FIG. 8 illustrates a detail of the starting portion of the slot.
Figure 9:
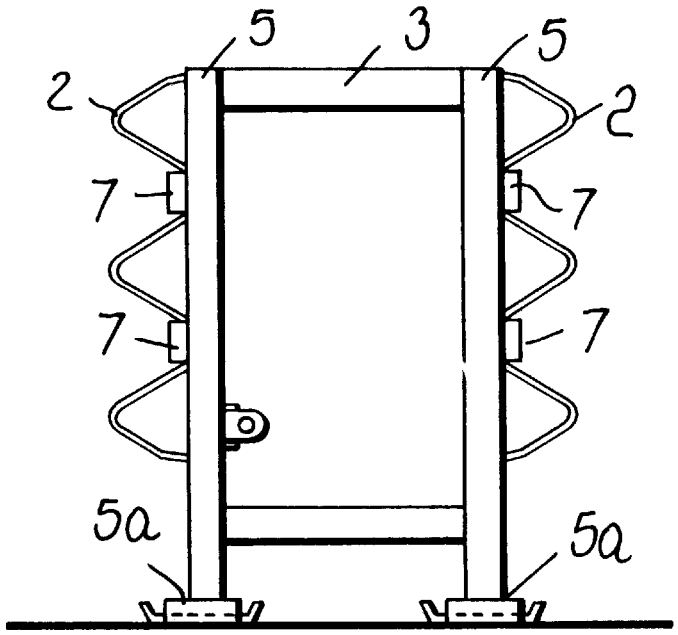
FIG. 9 illustrates a modified embodiment of the subject end assembly, including corrugated elements or panels provided with slots on both sides thereof.
Figure 10:
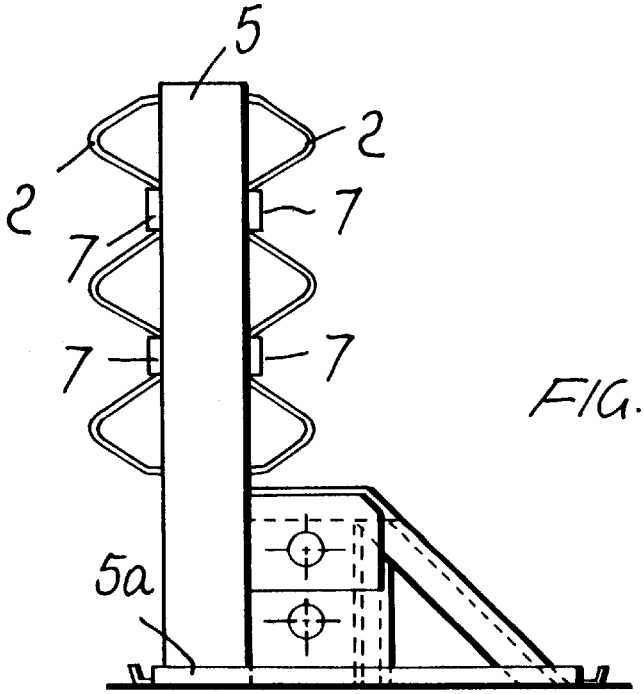
FIG. 10 illustrates yet another modified embodiment of the safety road barrier end assembly including corrugated elements provided with slots on both faces thereof and a central frame including a single section member portion.

More specifically, each supporting pier 3 comprises an upright 5, having at the bottom thereof a bearing foot 5*a* provided for bearing on the ground or the adjoining quay and a rear cross member 6 ending, at the bottom thereof, with a rear foot 6*a*. According to another possible embodiment, the supporting pier 3 comprises, as shown in FIG. 5, a pair of uprights 5 and 5', coupled by cross members to form a quadrangular frame.

More specifically, the corrugated elements 2 are coupled to the upright 5 by sliders 7, thereat the mentioned corrugated elements 2 are provided with elongated slots extending in a direction corresponding to the longitudinal extension of the barrier.

The sliders 7 are clamped by a preset clamping torque, thereby providing, in an impact event, a sliding with a friction controlled by the corrugated elements 2 with respect to the supporting piers 3 in the longitudinal direction of the barrier.

The corrugated element 2 is provided with two or more slots, in a longitudinal direction and at the valleys of the undulations. Said slots have a width slightly less than the diameter of the pin of the slider 7, thereby the latter, as it is mutually displaced with respect to said corrugated element, will provide a plastic deformation work on the sheet metal, thereby enlarging the cross size of the slot.

According to a preferred embodiment, the start end of the slot 9 has such a shape and size as to receive the slider pin, and being coupled to the following parallel-side portion 10 thereby reducing the starting impact opposing force. Moreover, in order to hold the slot sides in a parallel relationship, said slot is not a continuous slot, but the perforation of the slotted element 2 is performed in a discontinuous manner, so as to hold, at a preset spacing, sheet metal bridging elements 11, of negligible size with respect to the overall length of said slot, and operating as tierods. Said bridging elements 11, in particular, can be easily broken as the slider 7 is displaced under the motor vehicle impact, and they do not absorb any substantial energy.

The anchoring means for anchoring the supporting pier 3 to the ground comprise a guide cable 12, which is coupled to the ground at the end portions thereof, for example by spikes 13, which can be either anchored or bolted to the road surface or to the quay region.

As shown, the guide cable 12 engages, along its extension, with a portion of the supporting piers 3, thereby fixing said piers to the ground and holding them in a properly aligned condition.

The subject end assembly comprises moreover an end element 14, for example of fan shape, or any other visually suitable configuration, which is coupled at least one of the supporting piers 3.

In turn, the last supporting pier 3 is coupled to a pole of the fixed barrier or coupled and caused to bear on another pole suitably anchored in the ground, thereby supporting the longitudinal forces caused by the impacting vehicle without substantially opposing to the forces perpendicular to the barrier extension.

The elements forming the subject end assembly are preferably constituted by metal elements possibly protected by anti-corrosive and painting treatments.

The thus constructed end assembly is adapted to properly operate under any stress deriving from impacts, either angled or not, through the overall extension thereof, and this owing to its specifically designed construction.

In fact, the side stiffness necessary for partially absorbing and resiliently reacting against the impacting energy, is supplied by the cable 12 coupling the supporting piers 3.

The longitudinal component of the impact, in turn, is offset by the sliding of the front corrugated elements 2 and supporting piers 3, the sliders 7, as suitably sized and clamped under a preset clamping torque, dissipating the energy by friction and plastic deforming of the sheet metal material.

In the case of a mainly lateral impact, the end assembly, having its designed flexural strength, will be held and guided by the cable 12 coupling it to the ground.

Moreover, the end assembly comprises a comparatively reduced number of component pieces, which are easily available, and accordingly it can be easily installed, since it would be sufficient to cause it to bear on the ground and coupling it to the ground only by the anchoring elements of the guide cable 12 which can be made of suitable spikes 13 provided with corresponding throughgoing holes, to be engaged in corresponding holes drilled in the ground with any desired casting of suitable anchoring resins of high resistance and quick setting type, or by using poles driven to a given depth, of the type similar to those already used for longitudinal barrier uprights.

From the above disclosure and from the figures of the accompanying drawings it should be apparent that the invention fully achieves the intended aim and objects. In particular, a safety road barrier end assembly has been provided, which has a modular construction specifically designed for gradually absorbing the impact energy of motor vehicles and to redirect to their trajectories said impacting motor vehicles.

While the invention has been disclosed with reference to preferred embodiments thereof, it should be apparent that the disclosed embodiments are susceptible to several modifications and variations, all of which will come within the scope of the appended claims.

In practicing the invention, the used materials, as well as the contingent size and shapes, can be any, depending on requirements.

What is claimed is:

1. A safety road barrier end assembly, comprising a plurality of multiple corrugated horizontally extending lateral corrugated panels coupled to a plurality of vertical supporting piers by sliding coupling means allowing friction and plastic deformation in a direction parallel to a longitudinal extension of safety road barriers and anchoring means for anchoring said supporting piers to a ground, each said supporting pier comprising a plurality of ground bearing feet and said anchoring means comprising a guide pier engaging cable having end portions coupled to the ground, said sliding coupling means comprising sliders coupling said corrugated panels to said supporting piers, said sliders including engaging pins for engaging with corresponding longitudinal slots of said corrugated panels, said slots having a width less than the diameter of said pins of said sliders.

2. A safety road barrier end assembly, according to claim 1, wherein said slots have a starting portion adjoining a contact point with each said pin of each said slider, adapted to the diameter of said pin, thereby providing a gradual displacement of said pin under an impact force during movement.

3. A safety road barrier end assembly, according to claim 1, wherein said sliders are clamped to said panels and piers with a pre-set clamping torque for providing a controlled friction.

4. A safety road barrier end assembly, according to claim 1, wherein said cable engages with all said piers and is securely fastened to the last of said piers.

* * * * *